US009915901B2

(12) United States Patent
Kawata et al.

(10) Patent No.: US 9,915,901 B2
(45) Date of Patent: Mar. 13, 2018

(54) SEPARATION DEVICE, FIXING DEVICE, AND IMAGE FORMING APPARATUS

(71) Applicants: Teppei Kawata, Kanagawa (JP); Shinichi Namekata, Kanagawa (JP); Naoto Suzuki, Kanagawa (JP); Takashi Sakamaki, Kanagawa (JP); Masateru Ujiie, Kanagawa (JP)

(72) Inventors: Teppei Kawata, Kanagawa (JP); Shinichi Namekata, Kanagawa (JP); Naoto Suzuki, Kanagawa (JP); Takashi Sakamaki, Kanagawa (JP); Masateru Ujiie, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1 day.

(21) Appl. No.: 15/258,040

(22) Filed: Sep. 7, 2016

(65) Prior Publication Data

US 2017/0097600 A1 Apr. 6, 2017

(30) Foreign Application Priority Data

Oct. 6, 2015 (JP) ..... 2015-198568

(51) Int. Cl.
*G03G 15/20* (2006.01)

(52) U.S. Cl.
CPC ..... *G03G 15/2085* (2013.01)

(58) Field of Classification Search
USPC ..... 399/122, 321–323
See application file for complete search history.

(56) References Cited

U.S. PATENT DOCUMENTS

| | | | | |
|---|---|---|---|---|
| 8,433,228 | B2 * | 4/2013 | Keenan | B41F 17/007 399/323 |
| 8,478,148 | B2 * | 7/2013 | Nakatsuhara | G03G 15/2028 399/323 |
| 2012/0207523 | A1 | 8/2012 | Ueno et al. | |
| 2013/0001869 | A1 | 1/2013 | Ujiie | |
| 2013/0170877 | A1 | 7/2013 | Yoshiura et al. | |
| 2013/0189005 | A1 | 7/2013 | Saito et al. | |
| 2013/0209147 | A1 | 8/2013 | Ogawa et al. | |

(Continued)

FOREIGN PATENT DOCUMENTS

| | | |
|---|---|---|
| JP | 2007-057682 | 3/2007 |
| JP | 2007-065082 | 3/2007 |
| JP | 2008-203513 | 9/2008 |

(Continued)

*Primary Examiner* — Hoan Tran
(74) *Attorney, Agent, or Firm* — Harness, Dickey & Pierce, P.L.C.

(57) ABSTRACT

A separation device includes an endless belt, a rotary body, a separation supporter, and a transfer mechanism. The separation supporter presses against an inner circumferential surface of the endless belt downstream from an area of contact between the endless belt and the rotary body in a recording medium conveyance direction to curve the endless belt toward an outer circumferential surface side of the endless belt at a greater curvature than a curvature of the endless belt at the area of contact between the endless belt and the rotary body. The transfer mechanism switches the separation supporter between a first position and a second position farther from the area of contact between the endless belt and the rotary body than the first position.

14 Claims, 9 Drawing Sheets

(56) References Cited

U.S. PATENT DOCUMENTS

| | | | |
|---|---|---|---|
| 2013/0236225 | A1 | 9/2013 | Ogawa et al. |
| 2015/0168897 | A1 | 6/2015 | Ogawa et al. |

FOREIGN PATENT DOCUMENTS

| | | |
|---|---|---|
| JP | 2011-180344 | 9/2011 |
| JP | 2012-042853 | 3/2012 |
| JP | 2012-048110 | 3/2012 |
| JP | 2012-098610 | 5/2012 |
| JP | 2012-098704 | 5/2012 |
| JP | 2012-168434 | 9/2012 |
| JP | 2014-149373 | 8/2014 |
| JP | 2014-153486 | 8/2014 |
| JP | 2014-174528 | 9/2014 |
| JP | 2014-199382 | 10/2014 |
| JP | 2015-069041 | 4/2015 |

* cited by examiner

SEPARATION DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2015-198568, filed on Oct. 6, 2015, in the Japan Patent Office, the entire disclosure of which is hereby incorporated by reference herein.

BACKGROUND

Technical Field

Embodiments of the present disclosure generally relate to a separation device, a fixing device, and an image forming apparatus, and more particularly, to a separation device for separating a recording medium from an endless belt, a fixing device for fixing a toner image on a recording medium, and an image forming apparatus for forming an image on a recording medium.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A development device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium carrying the toner image to fix the toner image onto the recording medium. Thus, the image is formed on the recording medium.

Such a fixing device typically includes a fixing rotary body such as a roller, a belt, or a film, and an opposed rotary body such as a roller or a belt pressed against the fixing rotary body. The toner image is fixed onto the recording medium under heat and pressure while the recording medium is conveyed between the fixing member and the opposed member.

For example, a fixing device may include an endless belt heated by a heater while rotating and a rotary body to press against an outer circumference surface of the endless belt to form a fixing nip between the rotary body and the endless belt. A recording medium such as a paper sheet bearing a toner image is conveyed through the fixing nip while being heated. Thus, the fixing device fixes the toner image on the recording medium.

Such a fixing device may include a separation supporter to support separation of the recording medium from the endless belt to prevent the recording medium from wrapping around the endless belt after passing between the endless belt and the rotary body due to, e.g., viscosity of toner melting under heat.

SUMMARY

In one embodiment of the present disclosure, described is a novel separation device that includes an endless belt heated while rotating, and a rotary body to rotate while pressing against an outer circumferential surface of the endless belt to form an area of contact between the endless belt and the rotary body, through which a recording medium is conveyed while being heated. The separation device also includes a separation supporter and a transfer mechanism. The separation supporter presses against an inner circumferential surface of the endless belt downstream from the area of contact between the endless belt and the rotary body in a recording medium conveyance direction to curve the endless belt toward an outer circumferential surface side of the endless belt at a greater curvature than a curvature of the endless belt at the area of contact between the endless belt and the rotary body. The transfer mechanism switches the separation supporter between a first position and a second position farther from the area of contact between the endless belt and the rotary body than the first position.

Also described is a novel fixing device that includes a rotatable endless belt, a heater disposed opposite the endless belt to heat the endless belt, and a rotary body to rotate while pressing against an outer circumferential surface of the endless belt to form an area of contact between the endless belt and the rotary body, through which a recording medium bearing a toner image is conveyed while being heated. The fixing device also includes the separation supporter and the transfer mechanism described above.

Also described is a novel image forming apparatus that includes an image forming device to form a toner image and the fixing device described above.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
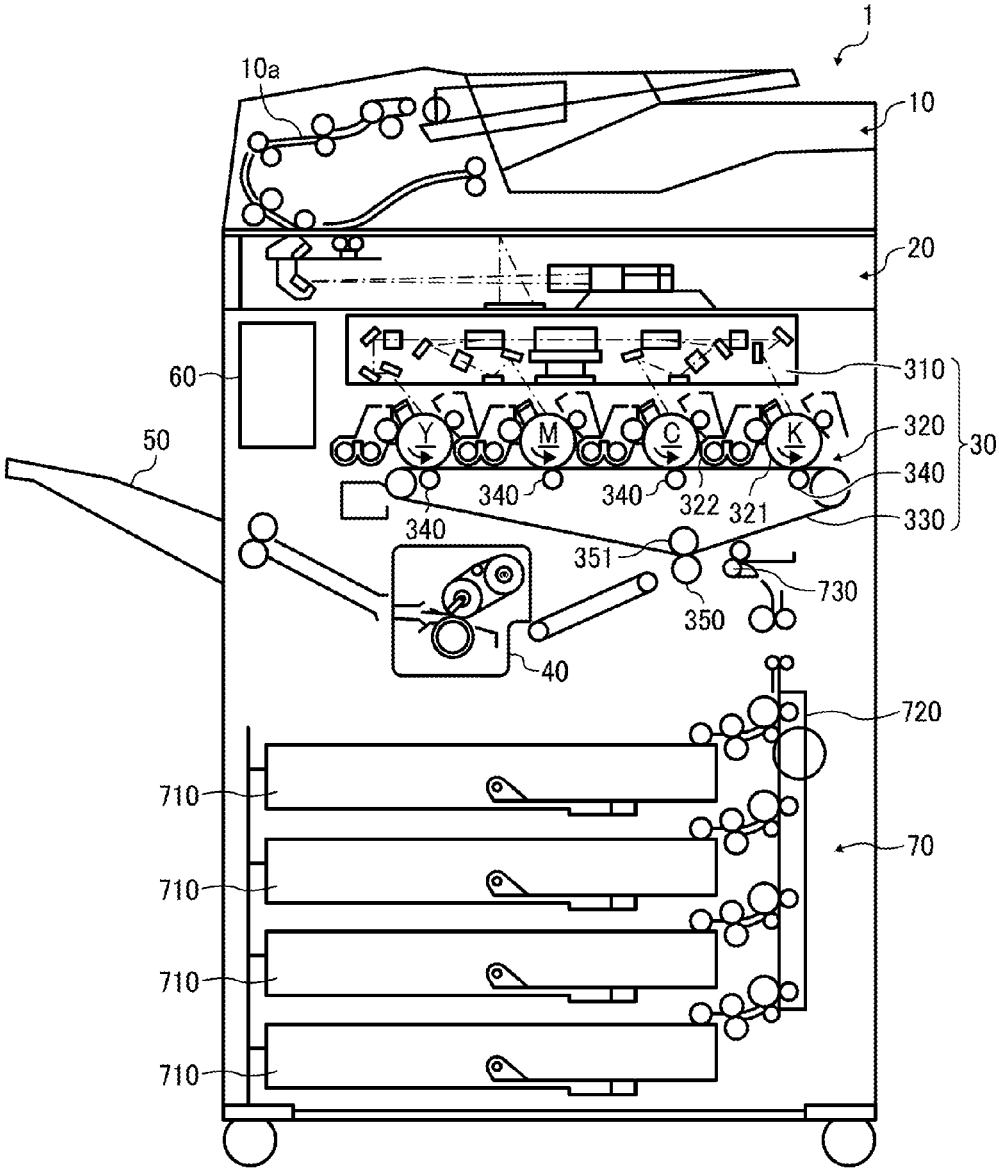
FIG. 1 is a schematic view of an image forming apparatus according to an embodiment of the present disclosure.

The accompanying drawings are intended to depict embodiments of the present disclosure and should not be interpreted to limit the scope thereof.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of the present disclosure are not necessarily indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

Referring now to the drawings, wherein like reference numerals designate identical or corresponding parts throughout the several views, embodiments of the present disclosure are described below.

Initially with reference to FIG. 1, a description is given of an image forming apparatus 1 according to an embodiment of the present disclosure.

FIG. 1 is a schematic view of the image forming apparatus 1.

The image forming apparatus 1 is a full-color printer that forms color and monochrome toner images on recording media by electrophotography.

Alternatively, however, the image forming apparatus 1 may be a monochrome printer that forms a monochrome toner image on a recording medium. The image forming apparatus 1 is not limited to a printer, but may be a copier, a facsimile machine, or a multifunction peripheral having one or more capabilities of these devices.

As illustrated in FIG. 1, the image forming apparatus 1 includes a document feeder 10, a scanner 20, an image forming device 30, a fixing device 40, a sheet ejection tray 50, a controller 60, and a sheet feeder 70.

The document feeder 10 imports documents one by one and conveys the documents along a conveyance passage 10*a*. The document feeder 10 is openably and closably supported by the scanner 20 via a hinge. The conveyance passage 10*a* includes a window facing and open to the scanner 20. The document bearing an image passes over the window with the image facing the scanner 20 while being conveyed along the conveyance passage 10*a*. The scanner 20 scans the image of the document when the document passes over the window.

The scanner 20 includes a slit glass and an exposure glass on an upper side of the scanner 20. The slit glass faces the window when the document feeder 10 is closed. The scanner 20 scans, via the slid glass, images of the documents conveyed by the document feeder 10 one by one. The exposure glass covers mostly the upper side of the scanner 20, which is exposed when the document feeder 10 is opened. In the present embodiment, the scanner 20 scans not only the image of the document conveyed by the document feeder 10, but also an image of a document placed on the exposure glass. The scanner 20 scans, via the exposure glass, the image of the document placed on the exposure glass such that the image faces the scanner 20 when the document feeder 10 is opened.

The image forming device 30 forms an image on a sheet serving as a recording medium from image data transmitted from the scanner 20. The image forming device 30 includes an exposure device 310 and image forming units 320 that respectively form toner images of yellow, magenta, cyan, and black. Each of the image forming units 320 includes a drum-shaped photoconductor 321 and a developing device 322 that develops a latent image with toner into a visible toner image. According to the image data transmitted from the scanner 20, the exposure device 310 exposes the photoconductor 321 included in each of the image forming units 320 to form an electrostatic latent image on the photoconductor 321. The developing device 322 develops the latent image with toner, rendering the latent image visible. Thus, toner images of yellow, magenta, cyan, and black are formed on the photoconductors 321 of the image forming units 320, respectively.

The image forming device 30 also includes an intermediate transfer belt 330, four primary transfer rollers 340 and a secondary transfer roller 350. The intermediate transfer belt 330 is entrained around a plurality of rollers. The four primary transfer rollers 340 are disposed opposite the photoconductors 321 of the image forming units 320, respectively, via the intermediate transfer belt 330. The secondary transfer roller 350 is disposed opposite a roller 351, which is one of the plurality of rollers around which the intermediate transfer belt 330 is entrained, via the intermediate transfer belt 330. The toner images of yellow, magenta, cyan, and black are transferred from the image forming units 320 onto the intermediate transfer belt 330 while being superimposed one atop another on the intermediate transfer belt 330 between the photoconductors 321 and the primary transfer rollers 340, respectively. Thus, a composite color toner image is formed on the intermediate transfer belt 330. Between the secondary transfer roller 350 and the roller 351, the color toner image is transferred onto a sheet serving as a recording medium conveyed from the sheet feeder 70.

The fixing device 40 fixes the toner image thus transferred onto the sheet under heat and pressure. Finally, the sheet bearing the fixed toner image is ejected onto the sheet ejection tray 50.

The controller 60 controls operations of various components of the image forming apparatus 1. For example, the controller 60 is operatively connected to the fixing device 40, thereby serving as a controller that controls an operation of the fixing device 40. A detailed description of one example of the embodiments which include the controller 60 and the fixing device 40 is deferred.

The sheet feeder 70 includes four sheet trays 710, a sheet sender 720, and a sheet conveyor 730. The four sheet trays 710 accommodates multiple types of sheets serving as recording media differing in at least one of thickness, i.e., stiffness, and size. At least one of the multiple types of sheets is, e.g., relatively thick and stiff paper, and the rest of the multiple types of sheets is, e.g., relatively thin and pliant paper.

The sheet sender 720 sends the sheets one by one from the sheet trays 710 to the sheet conveyor 730. The sheet conveyor 730 conveys the sheet to the image forming device 30. As described above, the image forming device 30 forms a toner image on the sheet thus conveyed. Then, the fixing device 40 fixes the toner image on the sheet.

Figure 2:
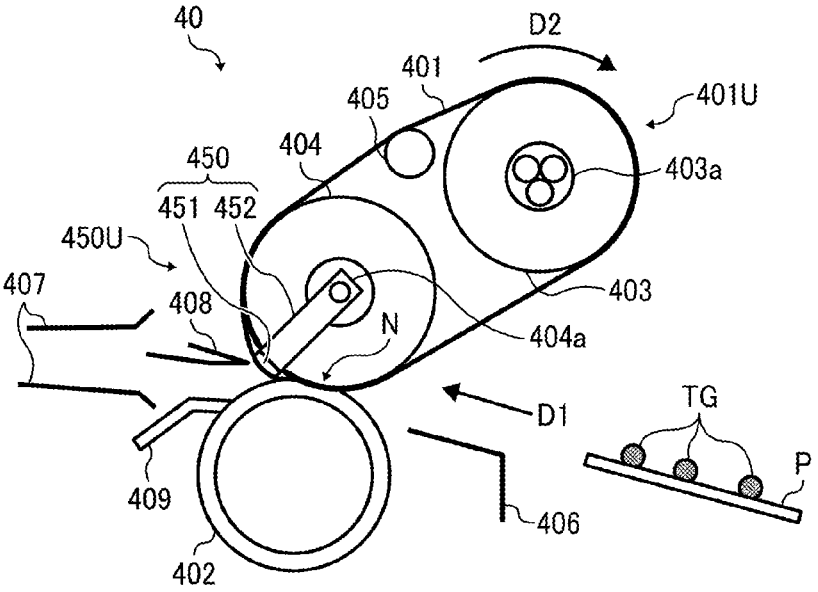
FIG. 2 is an enlarged schematic view of a fixing device incorporated in the image forming apparatus of FIG. 1, illustrating a separation pad close to a fixing nip.
Figure 3:
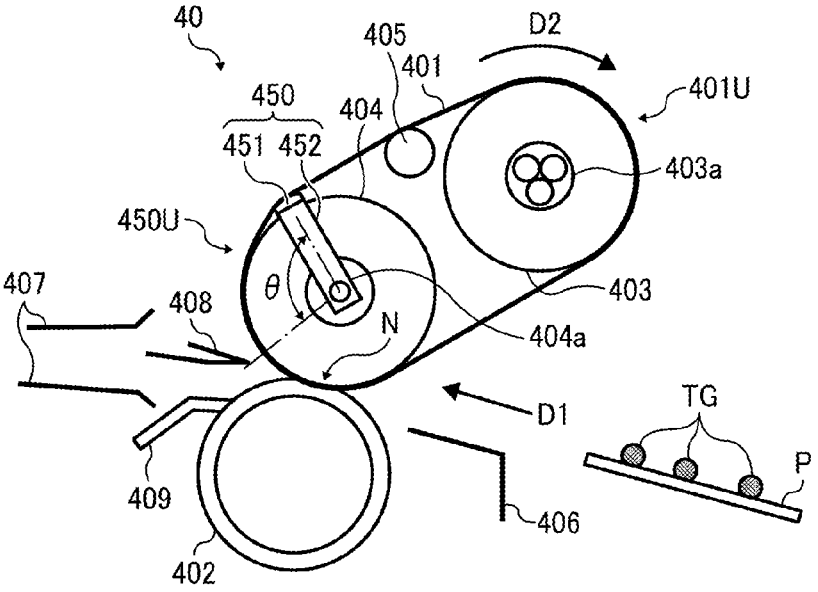
FIG. 3 is another enlarged schematic view of the fixing device incorporated in the image forming apparatus of FIG. 1, illustrating the separation pad far from the fixing nip.

Referring now to FIGS. 2 and 3, a description is given of the fixing device 40 and the control executed by the controller 60.

FIG. 2 is an enlarged schematic view of the fixing device 40 incorporated in the image forming apparatus 1 described above.

As illustrated in FIG. 2, the fixing device 40 includes a fixing belt 401 serving as a rotatable endless belt, and a pressure roller 402 serving as a rotary body.

The fixing device 40 also includes a heating roller 403 with a heater 403*a* embedded, a fixing roller 404 to stretch out the fixing belt 401 toward the pressure roller 402, and a tension roller 405. The fixing belt 401 is entrained around the heating roller 403, the fixing roller 404 and the tension roller 405. Thus, the heating roller 403 disposed opposite the fixing belt 401 serves as a heater to heat the fixing belt 401. The fixing roller 404 is rotatable about a rotational shaft 404*a* that extends in a width direction of the fixing belt 401, which is perpendicular to a rotational direction D2 of the fixing belt 401. The pressure roller 402 is pressed against the fixing roller 404 via the fixing belt 401. Specifically, the pressure roller 402 is pressed against an outer circumferential surface of the fixing belt 401 to form an area of contact, herein called a fixing nip N, between the pressure roller 402 and the fixing belt 401. A sheet P serving as a recording medium and bearing a toner image TG is conveyed in a conveyance direction D1 and reaches the fixing nip N. The sheet P is heated while being sandwiched by the fixing belt 401 and the pressure roller 402, thereby passing through the fixing nip N.

An entrance guide 406 is disposed on an entrance side of the fixing nip N along the conveyance direction D1, so as to guide the sheet P into the fixing nip N. On the other hand, an exit guide 407 is disposed on an exit side of the fixing nip N along the conveyance direction D1, so as to guide the sheet P bearing the toner image TG fixed thereto toward the sheet ejection tray 50.

Additionally, on the exit side of the fixing nip N, a belt-side block board 408 is disposed to direct the sheet P passing through the fixing nip N and separating from the fixing belt 401, as described below, toward the exit guide 407, so as to prevent the sheet P from adhering to the fixing belt 401 again. The belt-side block board 408 is disposed such that an edge facing the fixing belt 401 is slightly away from the fixing belt 401. Thus, the belt-side block board 408 is not in contact with the fixing belt 401. On the exit side of the fixing nip N, a roller-side block board 409 is also disposed to direct the sheet P toward the exit guide 407, so as to prevent the sheet P from adhering to the pressure roller 402. The surface of the pressure roller 402 is harder than the surface of the fixing belt 401. Therefore, the roller-side block board 409 is disposed such that an edge facing the pressure roller 402 slidably contacts the pressure roller 402.

Generally, after passing between an endless belt and a rotary body in a fixing device, a recording medium tends to wrap around the endless belt due to, e.g., viscosity of toner melting under heat. Hence, according to a first embodiment of the present disclosure, the fixing device 40 includes a separation support mechanism 450 that supports separation of the sheet P from the fixing belt 401 after the sheet P passes through the fixing nip N, upstream from the belt-side block board 408 in the conveyance direction D1.

The controller 60 is operatively connected to the separation support mechanism 450, thereby serving as a controller that controls an operation of the separation support mechanism 450. A detailed description of one example of the embodiments, which includes the controller 60 and the separation support mechanism 450, is deferred.

As illustrated in FIG. 2, a separation device 450U includes the fixing belt 401, the pressure roller 402, the heating roller 403 with the heater 403*a* embedded, the fixing roller 404, and the separation support mechanism 450. A belt unit 401U, separably coupled with the pressure roller 402, includes the fixing belt 401 and the components disposed inside a loop formed by the fixing belt 401, that is, the heating roller 403 with the heater 403*a* embedded, the fixing roller 404, the tension roller 405, and the separation support mechanism 450.

The separation support mechanism 450 includes a separation pad 451 serving as a separation supporter that supports the separation of the sheet P, and a transfer mechanism 452 that moves the separation pad 451 as described below.

The separation pad 451 is pressed against an inner circumferential surface of the fixing belt 401, downstream from the fixing nip N in the conveyance direction D1 of the sheet P. The separation pad 451 is disposed between the fixing roller 404 and the fixing belt 401. Specifically, the separation pad 451 is pressed against the inner circumferential surface of the fixing belt 401 to curve the fixing belt 401 outwards, i.e., toward the outer circumferential surface side of the fixing belt 401, at a greater curvature than a curvature of the fixing belt 401 at the fixing nip N. Thus, the separation pad 451 supports the separation of the sheet P from the fixing belt 401.

In the present embodiment, the fixing device 40 employs a self-stripping method to separate the sheet P from the fixing belt 401. The self-stripping method uses the stiffness of the sheet P to naturally peel the sheet P off the fixing belt 401 moving away from the fixing nip N while curing on the exit side of the fixing nip N. The separation pad 451 curves the fixing belt 401 downstream from the fixing nip, i.e., on the exit side of the fixing nip N, such that the curvature of fixing belt 401 there is greater than the curvature of the fixing belt 401 at the fixing nip N. Thus, removal of the sheet P from the fixing belt 401 is enhanced.

The transfer mechanism 452 holds the separation pad 451 while switching the separation pad 451 between a first position, which is relatively close to the fixing nip N in the rotational direction D2 of the fixing belt 401, and a second position, which is relatively far from the fixing nip N in the rotational direction D2 of the fixing belt 401. In FIG. 2, the transfer mechanism 452 situates the separation pad 451 at the first position relatively close to the fixing nip N.

FIG. 3 is another enlarged schematic view of the fixing device 40 incorporated in the image forming apparatus 1 of FIG. 1, illustrating the separation pad 451 situated at the second position relatively far from the fixing nip N.

In the present embodiment, the transfer mechanism 452 rotates the separation pad 451 about a rotational axis coaxial with the rotational shaft 404*a* of the fixing roller 404.

In this way, the fixing roller 404 serves as a separation support rotary body.

Generally, in the self-stripping method, a thin sheet may not be stiff enough to be peeled off the fixing belt. By contrast, a thick sheet may be stiff enough to be peeled off the fixing belt. In the present embodiment, the transfer mechanism 452 situates the separation pad 451 at the first position as illustrated in FIG. 2, in the event that the sheet P is relatively thin, thereby enhancing the separation of the sheet P from the fixing belt 401. On the other hand, the transfer mechanism 452 situates the separation pad 451 at the second position as illustrated in FIG. 3, in the event that the sheet P is relatively thick, so that the sheet P separates from the fixing belt 401 due to the stiffness of the sheet P. In the present embodiment, the second position illustrated in FIG. 3 is away from the first position illustrated in FIG. 2 at a rotational angle θ of 100 degrees, for example. However, the rotational angle θ is not limited to 100 degrees. Alternatively, the rotational angle θ may be 50 degrees, for example.

Figure 4:
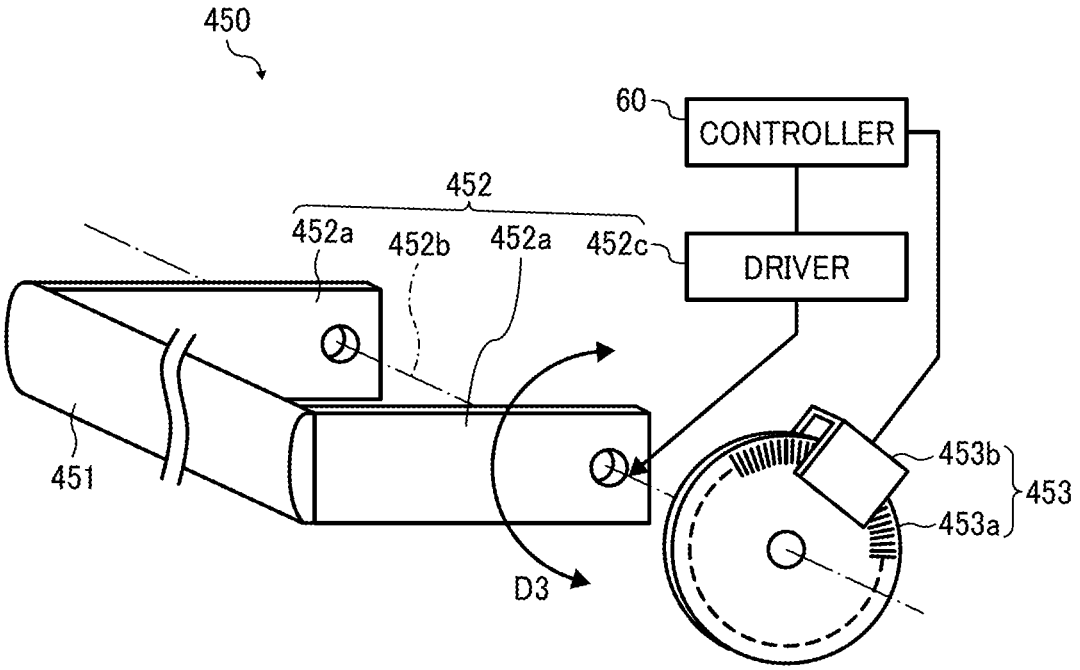
FIG. 4 is a schematic view of a separation support mechanism according to a first embodiment of the present disclosure.

Referring now to FIG. 4, a detailed description is given of the separation support mechanism 450 according to the first embodiment of the present disclosure.

FIG. 4 is a schematic view of the separation support mechanism 450.

In the separation support mechanism 450, the separation pad 451 is a rectangular board having a curved surface facing the fixing belt 401. The separation pad 451 is longer than the width of the fixing belt 401 and the length of the fixing roller 404. The transfer mechanism 452 includes a pair of retention arms 452*a*, a rotational axis 452*b* and a driver 452*c*. The rotational axis 452*b* is coaxial with the rotational shaft 404*a* of the fixing roller 404. The pair of retention arms 452*a* is elongated from opposed end portions of the separation pad 451 to the rotational axis 452*b* outside opposed end portions of the fixing roller 404. The pair of retention arms 452*a* is rotatable about the rotational axis 452*b* in a rotational direction D3 with the fixing roller 404 interposed therebetween. The driver 452*c* including a motor and a transmission gear rotates the pair of retention arms 452*a*, and therefore, the driver 452*c* rotates the separation pad 451.

The separation support mechanism 450 also includes a rotary encoder 453 to detect a rotational angle of the pair of retention arms 452*a*, that is, a rotational angle of the separation pad 451. The rotary encoder 453 includes a disk portion 453*a* and a photointerrupter 453*b*. The disk portion 453*a* has a plurality of slits arranged in a circumferential direction of the disk portion 453*a*. The photointerrupter 453*b* includes a light-emitting portion and a light-receiving portion, between which the plurality of slits of the disk portion 453*a* are interposed. As the disk portion 453*a* rotates, light from the light-emitting portion passes through the slits and blocked between the slits. Accordingly, the photointerrupter 453*b* outputs a pulse signal. The controller 60 of the image forming apparatus 1 receives the pulse signal thus output. According to the pulse signal, the controller 60 obtains a rotational angle of the disk portion 453*a*.

The disk portion 453*a* rotates in conjunction with the pair of retention arms 452*a* of the transfer mechanism 452. By obtaining the rotational angle of the disk portion 453*a*, the controller 60 detects the position of the pair of retention arms 452*a*, and therefore, the controller 60 detects the position of the separation pad 451. Upon transferring the separation pad 451 from the second position of FIG. 3 to the first position of FIG. 2, the transfer mechanism 452 stops moving the separation pad 451 in response to a direction from the controller 60 detecting that the separation pad 451 is situated at the first position. By contrast, upon transferring the separation pad 451 from the first position of FIG. 2 to the second position of FIG. 3, the transfer mechanism 452 stops moving the separation pad 451 in response to a direction from the controller 60 detecting that the separation pad 451 is situated at the second position. Thus, the transfer mechanism 452 moves the separation pad 451 according to a detected position of the separation pad 451 in response to the direction from the controller 60.

Figure 5A:
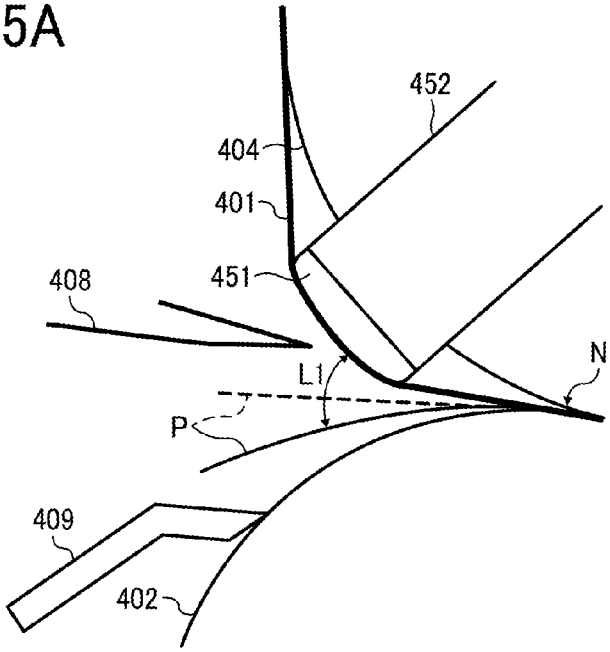
FIG. 5A is a partial view of the fixing device of FIG. 2, illustrating a neighborhood of the fixing nip, close to which the separation pad is situated.
Figure 5B:
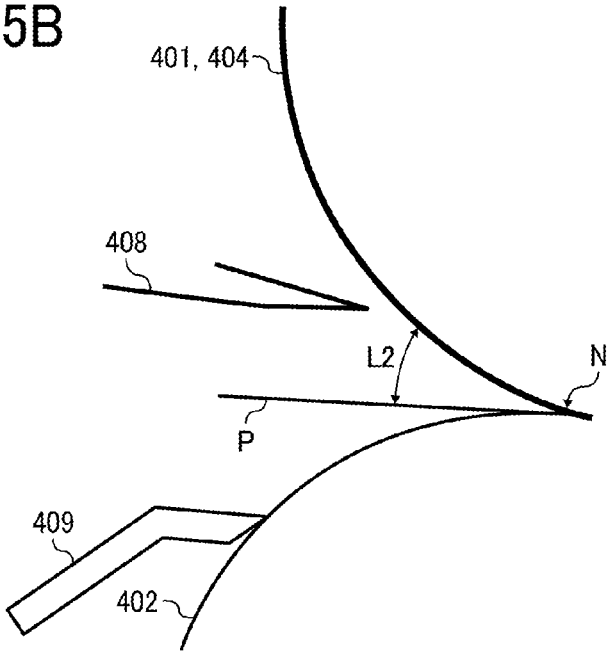
FIG. 5B is a partial view of the fixing device of FIG. 3, illustrating the neighborhood of the fixing nip, away from which the separation pad is situated.

Referring now to FIGS. 5A and 5B, a description is given of a reason for the transfer mechanism 452 moving the separation pad 451 as described above.

FIG. 5A is a partial view of the fixing device 40, illustrating a neighborhood of the fixing nip N, close to which the separation pad 451 is situated. FIG. 5B is a partial view of the fixing device 40, illustrating the neighborhood of the fixing nip N, far from which the separation pad 451 is situated. Specifically, in FIG. 5A, the separation pad 451 is situated at the first position. In FIG. 5B, the separation pad 451 is situated at the second position.

When the separation pad 451 is situated at the first position as illustrated in FIG. 5A, the fixing belt 401 curved by the separation pad 451 projects toward the pressure roller 402 on the exit side of the fixing nip N. Accordingly, the fixing belt 401 separates from the sheet P passing through the fixing nip N, along an upward passage in FIG. 5A at a steep angle, thereby enhancing the separation of the sheet P from the fixing belt 401.

If the sheet P is relatively thin, the sheet P sinks down due to its own weight after separating from the fixing belt 401 and is directed to between the belt-side block board 408 and the roller-side block board 409 at a relatively long distance L1 from the fixing belt 401 as indicated by a solid line in FIG. 5A. By contrast, if the sheet P is relatively thick, the stiffness of the sheet P reliably prevents the sheet P from sinking down after separating from the fixing belt 401. Therefore, the sheet P is directed to between the belt-side block board 408 and the roller-side block board 409 as indicated by a broken line in FIG. 5A. In this case, as illustrated in FIG. 5A, the distance between the sheet P and the projecting portion of the fixing belt 401 is shorter than the distance L1.

With such a short distance between the sheet P and the fixing belt 401, heat from the fixing belt 401 as a heater may affect the quality of a fixed toner image on the sheet P after the sheet P passes through the fixing nip N.

Figure 6A:
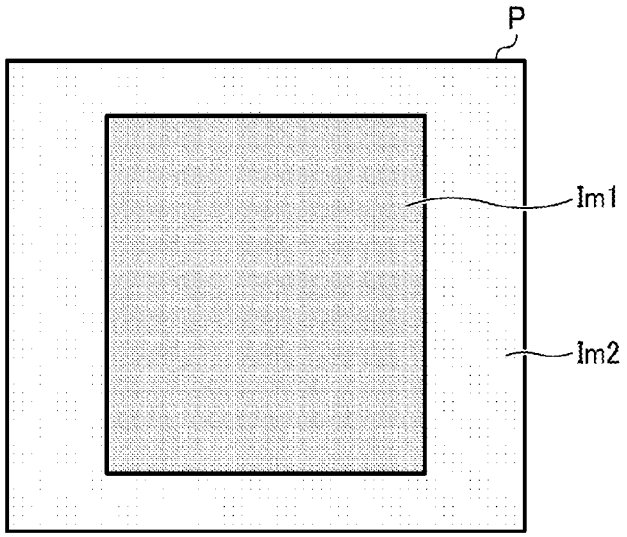
FIG. 6A is a plan view of a recording medium after passing through the fixing nip, illustrating an exemplary influence on the quality of a fixed toner image by the heat from a fixing belt incorporated in the fixing device.
Figure 6B:
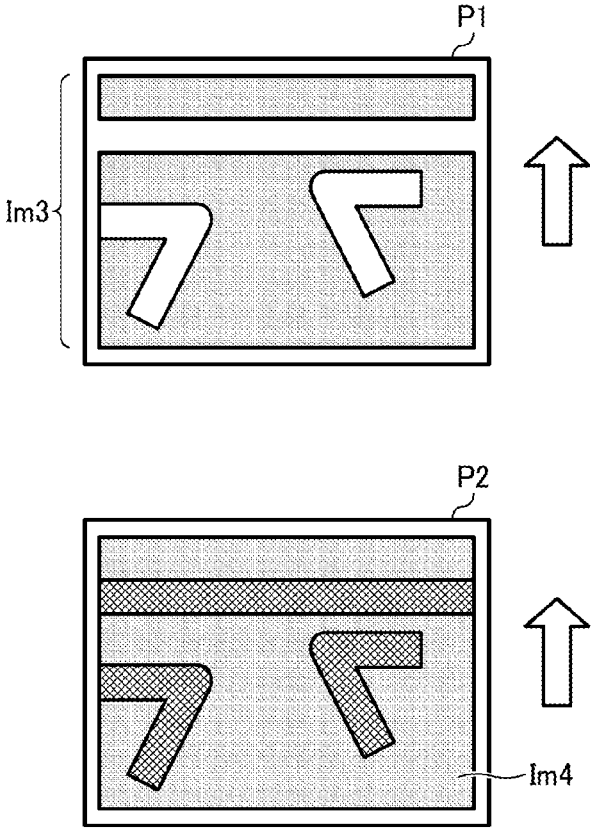
FIG. 6B is a plan view of two consecutive recording media after passing through the fixing nip, illustrating another exemplary influence on the quality of a fixed toner image by the heat from the fixing belt incorporated in the fixing device.

Referring now to FIGS. 6A and 6B, a description is given of exemplary influences that heat from the fixing belt 401 has on the quality of a fixed toner image on a recording medium after the recording medium passes through the fixing nip N.

FIG. 6A is a plan view of a sheet P as a recording medium after passing through the fixing nip, illustrating an exemplary influence on the quality of a fixed toner image by the heat from the fixing belt 401. FIG. 6B is a plan view of two consecutive sheets P1 and P2 as recording media after passing through the fixing nip, illustrating another exemplary influence on the quality of a fixed toner image by the heat from the fixing belt 401.

In FIGS. 6A and 6B, the fixed toner images on the sheets P and P2 have uneven gloss due to the heat from the fixing belt 401. Specifically, in FIG. 6A, a solid toner image is fixed on a whole surface of the sheet P. Normally, a fixed toner image has an even gloss across a whole surface of a sheet. However, in FIG. 6A, the fixed toner image includes two images differing in gloss, namely, an image Im1 located in the center of the sheet P and an image Im2 encompassing the image Im1. Thus, the fixed toner image appears as an edged image.

In FIG. 6B, an image Im3 including outlined portions is fixed on the sheet P1 whereas a solid image Im4 is fixed on a whole surface of the sheet P2 following the sheet P1. In this example, the solid image Im4 of the sheet P2 has portions corresponding to the outlined portions of the image Im3 of the sheet P1, differing in gloss from other portions of the sheet P2.

If the sheet P is relatively thin, the sheet P is separate from the fixing belt 401 after passing through the fixing nip N at the distance L1 as indicated by the solid line in FIG. 5A. The distance L1 between the sheet P and the fixing belt 401 is sufficient to reduce the influence that the heat from the fixing belt 401 has on the image quality.

On the other hand, if the sheet P is relatively thick and stiff, the sheet P tends to be close to the fixing belt 401 after passing through the fixing nip N. Therefore, the separation pad 451 is disposed at the second position illustrated in FIG. 3. The stiffness of the thick sheet P naturally separates the sheet P from the fixing belt 401 without assistance from the separation pad 451. As illustrated in FIG. 5B, the fixing belt 401 separates from the sheet P while moving along an outer circumference of the fixing roller 404, keeping far away from the sheet P. Thus, after passing through the fixing nip N, the thick sheet P is directed to between the belt-side block board 408 and the roller-side block board 409 at a relatively long distance L2, which is sufficient to reduce the influence that the heat from the fixing belt 401 has on the image quality.

In the present embodiment, the controller 60 receives, e.g., a manual sheet selection setting through a control panel of the image forming apparatus 1 or sheet selection data transmitted together with image data from outside the image forming apparatus 1. The sheet selection setting that the controller 60 receives includes information on the type of sheet thus selected, that is, the stiffness of sheet. The controller 60 instructs the sheet feeder 70 to send out the selected sheet from one of the sheet trays 710. The selected sheet bears a toner image on the way to the fixing nip N in the fixing device 40.

Thus, in the present embodiment, the fixing nip N receives the sheet thus selected from a plurality of types of sheets differing in stiffness, as the sheet P on which a toner image is fixed. The controller 60 serves as a sheet type identification unit that identifies the type of the sheet P. According to an identification result, the controller 60 instructs the driver 452*c* in the transfer mechanism 452 of the separation support mechanism 450. Consequently, if the sheet P is relatively thin and pliant, the driver 452*c* disposes the separation pad 451 at the first position illustrated in FIG. 2. By contrast, if the sheet P is relatively thick and stiff, the driver 452*c* disposes the separation pad 451 at the second position illustrated in FIG. 3.

Thus, in the present embodiment, the influences is reduced that the incorporation of the separation pad 451 of the separation support mechanism 450 in the fixing device 40 has on the sheet P.

Additionally, in the present embodiment, the transfer mechanism 452 rotates the separation pad 451 about the rotational axis 452*b* coaxial with the rotational shaft 404*a* of the fixing roller 404 around which the fixing belt 401 is entrained. Such a configuration restrains the change in tension applied to the fixing belt 401 around the fixing roller 404 when the separation pad 451 is moved. Accordingly, the durability of the fixing belt 401 is maintained against a tensile load for a relatively long period of time.

Further, in the present embodiment, the controller 60 serves as a sheet type identification unit that identifies the type of the sheet P, on which a toner image is fixed at the fixing nip N. The transfer mechanism 452 moves the position of the separation pad 451 in response to the identification by the controller 60, Thus, according to the type of the sheet P, that is, the stiffness of the sheet P, the influences is efficiently and accurately reduced that the incorporation of the separation pad 451 has on the sheet P.

Figure 7A:
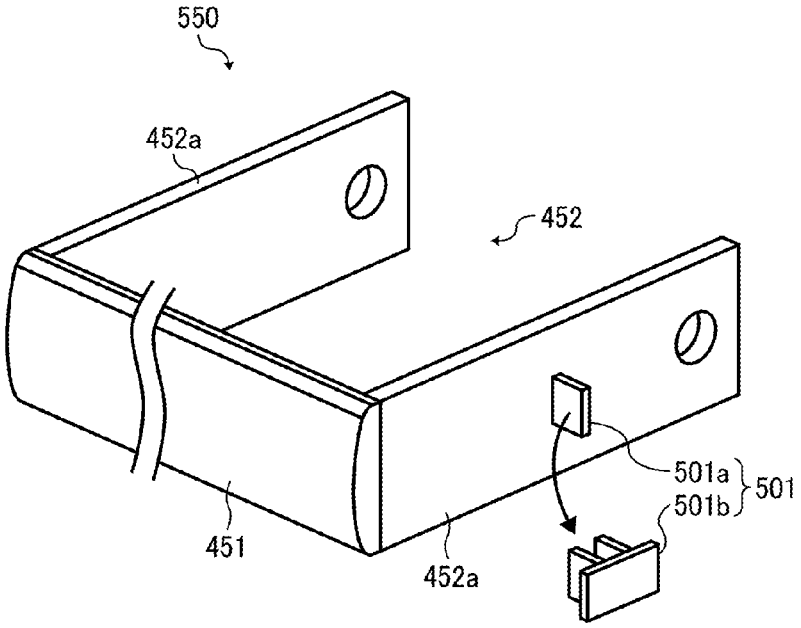
FIG. 7A is a perspective view of a separation support mechanism according to a second embodiment of the present disclosure.
Figure 7B:
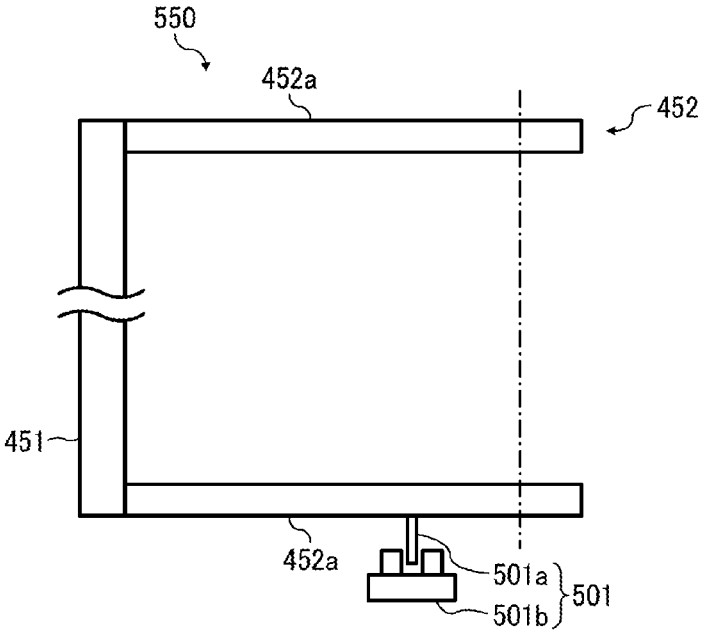
FIG. 7B is a cross-sectional view of the separation support mechanism of FIG. 7A.
Figure 8:
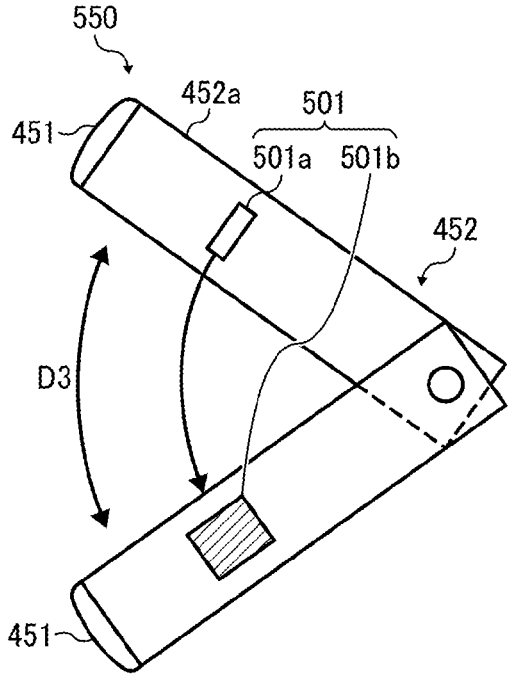
FIG. 8 is a schematic view of the separation support mechanism of FIGS. 7A and 7B, illustrating how a separation pad is positioned in the separation support mechanism.

Referring now to FIGS. 7A through 8, a description is given of a separation support mechanism 550 according to a second embodiment of the present disclosure.

Unlike the separation support mechanism 450 according to the first embodiment, the separation support mechanism 550 according to the second embodiment includes, on top of a rotary encoder 453, another sensor for positioning a separation pad 451. Otherwise, the separation support mechanisms 450 and 550 according to the first and second embodiments, respectively, have identical configurations. Therefore, redundant descriptions thereof are herein omitted.

FIG. 7A is a perspective view of the separation support mechanism 550. FIG. 7B is a cross-sectional view of the separation support mechanism 550 of FIG. 7A. FIG. 8 is a schematic view of the separation support mechanism 550 of FIGS. 7A and 7B, illustrating how the separation pad 451 is positioned in the separation support mechanism 550.

Like the separation support mechanism 450 described above, the separation support mechanism 550 includes the separation pad 451 and a transfer mechanism 452 that includes a pair of retention arms 452*a*. Additionally, in the second embodiment, the separation support mechanism 550 includes a photosensor 501 to detect that the separation pad 451 is situated at the first position illustrated in FIG. 2. The photosensor 501 includes a feeler 501*a* and a photointerrupter 501*b*. The feeler 501*a* is mounted on one of the pair of retention arms 452*a*. The photointerrupter 501*b* is provided at a position corresponding to the first position illustrated in FIG. 2. The photosensor 501 includes a light-emitting portion and a light-receiving portion facing each other. When the separation pad 451 is situated at the first position illustrated in FIG. 2, the feeler 501*a* mounted on one of the pair of retention arms 452*a* is interposed between the light-emitting portion and the light-receiving portion. Thus, the photointerrupter 501*b*, i.e., the photosensor 501, is activated when the separation pad 451 is situated at a position other than the first position. On the other hand, the photointerrupter 501*b*, i.e., photosensor 501, is deactivated when the separation pad 451 is situated at the first position. Accordingly, the photosensor 501 detects that the separation pad 451 is situated at the first position illustrated in FIG. 2. An output from the photosensor 501 is transmitted to a driver 452*c* of the transfer mechanism 452 via the controller 60. Upon transferring the separation pad 451 from the second position to the first position, the driver 452*c* of the transfer mechanism 452 stops the separation pad 451 coming from the second position when the photosensor 501 detects that the separation pad 451 is situated at the first position.

It is to be noted that situating the separation pad 451 at the second position may not be strictly controlled provided that the fixing belt 401 is relatively far from the sheet P. In the separation support mechanism 550, the driver 452*c* of the transfer mechanism 452 rotates the separation pad 451 at a rotational angle of 100 degrees according to an output signal from the rotary encoder 453, when transferring the separation pad 451 from the second position to the first position.

On top of the photointerrupter 501*b* as a first photointerrupter, another photointerrupter as a second photointerrupter may be disposed at a position corresponding to the second position to situate the separation pad 451 at the second position according to an output from the second photointerrupter. In this case, the rotary encoder 453 is rendered unnecessary.

Figure 9:
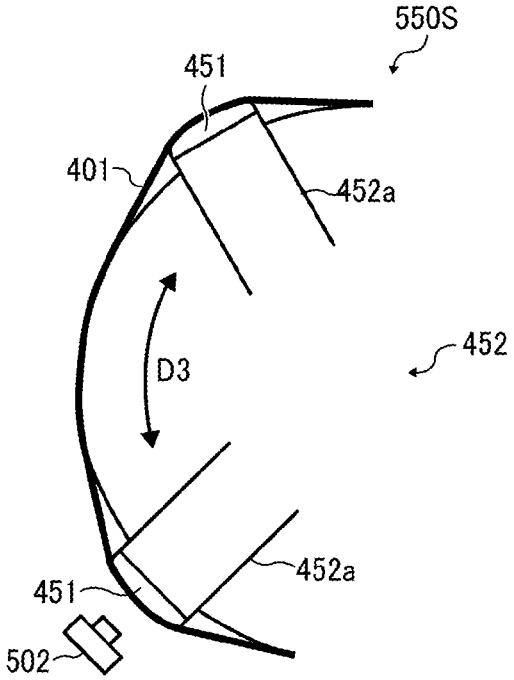
FIG. 9 is a schematic view of a variation of the separation support mechanism according to the second embodiment, incorporating a sensor for positioning the separation pad.

Referring now to FIG. 9, a description is given of a variation of the separation support mechanism 550.

FIG. 9 is a schematic view of a separation support mechanism 550S as a variation of the separation support mechanism 550, incorporating a perspective sensor 502 for positioning the separation pad 451.

In the separation support mechanism 550S, the perspective sensor 502 is disposed at a position corresponding to the first position so as to detect that the separation pad 451 is situated at the first position illustrated in FIG. 2. Specifically, the perspective sensor 502 is disposed opposite the outer circumferential surface of the fixing belt 401 so as to detect a distance between the perspective sensor 502 and the outer circumferential surface of the fixing belt 401. When the separation pad 451 is situated at the first position, a part of the outer circumferential surface of the fixing belt 401 facing the perspective sensor 502 projects toward the perspective sensor 502. Consequently, the distance is shortened between the perspective sensor 502 and the part of the outer circumferential surface of the fixing belt 401 facing the perspective sensor 502. The shortened distance allows the perspective sensor 502 to detect that the separation pad 451 is situated at the first position illustrated in FIG. 2. An output from the perspective sensor 502 is transmitted to the driver 452*c* of the transfer mechanism 452 via the controller 60. Upon transferring the separation pad 451 from the second position to the first position, the driver 452*c* of the transfer mechanism 452 stops the separation pad 451 coming from the second position when the perspective sensor 502 detects that the separation pad 451 is situated at the first position.

On the other hand, situating the separation pad 451 at the second position is controlled according to an output signal from the rotary encoder 453.

On top of the perspective sensor 502 as a first perspective sensor, another perspective sensor as a second perspective sensor may be disposed at a position corresponding to the second position to situate the separation pad 451 at the second position. In this case, the rotary encoder 453 is rendered unnecessary.

As described above, in the second embodiment including the variation described above, the transfer mechanism 452 moves the separation pad 451 in response to detection by the rotary encoder 453 and another sensor such as the photosensor 501 and the perspective sensor 502. As described above, the transfer mechanism 452 may move the separation pad 451 in response to detection by the photosensors (e.g., photosensor 501) or the perspective sensors (e.g., perspective sensor 502), without using the rotary encoder 453.

Accurate positioning control at the first position enhances appropriate curving of the fixing belt 401 near the fixing nip N using the separation pad 451 to support separation of the sheet P from the fixing belt 401. According to the second embodiment described above, the separation pad 451 is accurately situated at the first position because the photosensor 501 or the perspective sensor 502 directly detects that the separation pad 451 is situated at the first position.

Referring now to FIGS. 10 through 14, a description is given of a separation support mechanism 650 according to a third embodiment of the present disclosure.

Unlike the separation support mechanism 450 according to the first embodiment, the separation support mechanism 650 according to the third embodiment includes transfer regulators 653 to regulate the movement of a separation pad 451 toward the fixing nip N from the first position illustrated in FIG. 2.

Otherwise, the separation support mechanisms 450 and 650 according to the first and third embodiments, respectively, have identical configurations. Therefore, redundant descriptions thereof are herein omitted.

Figure 10:
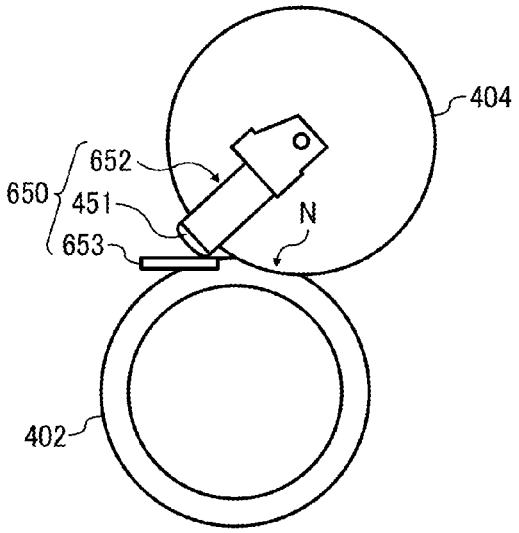
FIG. 10 is a schematic view of a separation support mechanism according to a third embodiment of the present disclosure, with a fixing roller and a pressure roller incorporated in the fixing device of FIGS. 2 and 3.
Figure 11:
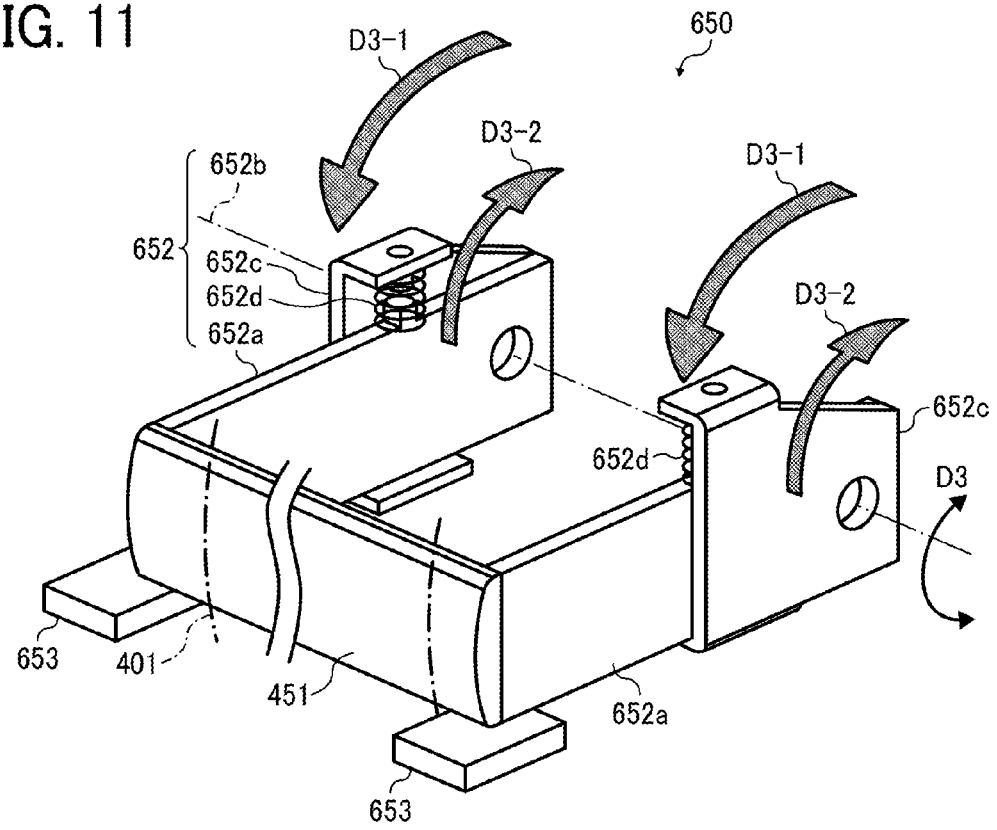
FIG. 11 is an enlarged schematic view of the separation support mechanism of FIG. 10.

FIG. 10 is a schematic view of the separation support mechanism 650 with the fixing roller 404 and the pressure roller 402 incorporated in the fixing device 40. FIG. 11 is an enlarged schematic view of the separation support mechanism 650 of FIG. 10.

In the separation support mechanism 650, the transfer regulators 653 are disposed at a position corresponding to the first position illustrated in FIG. 2. Specifically, the transfer regulators 653 are disposed adjacent to opposed edges of the fixing belt 401 individually. When a transfer mechanism 652 moves the separation pad 451 toward the first position in a direction D3-1, opposed end portions of the separation pad 451 contact the transfer regulators 653, thereby being regulated not to move farther in the direction D3-1 toward the fixing nip N.

In the present embodiment, the transfer mechanism 652 includes a pair of retention arms 652*a*, a rotational axis 652*b*, a pair of arm holders 652*c* serving as holders, and a pair of absorption springs 652*d* serving as absorbers. Like the pair of retention arms 452*a* according to the first embodiment, the pair of retention arms 652*a* is elongated from the opposed end portions of the separation pad 451 to the rotational axis 652*b* coaxial with the rotational shaft 404*a* of the fixing roller 404, outside opposed end portions of the fixing roller 404. The pair of retention arms 652*a* is rotatable about the rotational axis 652*b* in a rotational direction D3 with the fixing roller 404 interposed therebetween. Unlike the pair of retention arms 452*a*, however, the pair of retention arms 652*a* is not directly rotated by a driver 452*c* as illustrated in FIG. 4. Like the separation support mechanism 450 according to the first embodiment, the separation support mechanism 650 includes a rotary encoder 453 as illustrated in FIG. 4, to detect a rotational angle of the pair of retention arms 652*a*, that is, a rotational angle of the separation pad 451.

The pair of arm holders 652*c* is disposed corresponding to the pair of retention arms 652*a*, to hold an end portion, through which the rotational axis 652*b* passes, of the corresponding retention arm 652*a*. In the present embodiment, the pair of arm holders 652*c* is rotated by the driver 452*c*. The rotary encoder 453 also detects a rotational angle of the pair of arm holders 652*c*.

Figure 12A:
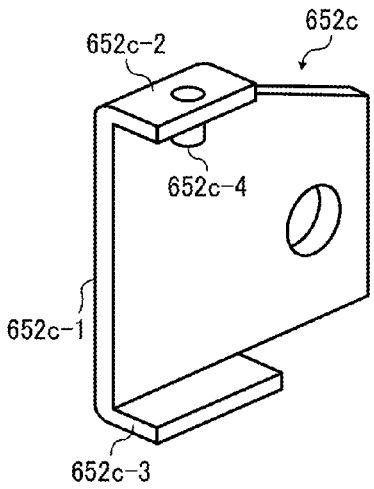
FIG. 12A is a schematic view of one of a pair of arm holders incorporated in the separation support mechanism of FIG. 11.
Figure 12B:
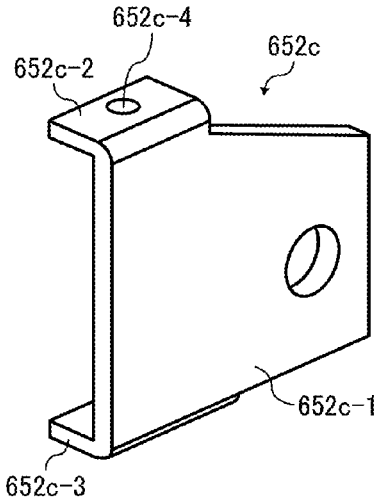
FIG. 12B is a schematic view of the other one of the pair of arm holders incorporated in the separation support mechanism of FIG. 11.

FIG. 12A is a schematic view of a left arm holder of the pair of arm holders 652*c*. FIG. 12B is a schematic view of a right arm holder of the pair of arm holders 652*c*.

Each of the pair of arm holders 652*c* includes a board portion 652*c*-1 elongated parallel to the board-shaped retention arm 652*a*. The rotational axis 652*b* passes through the board portion 652*c*-1. Each of the pair of arm holders 652*c* also includes an upper-wall portion 652*c*-2 and a lower-wall portion 652*c*-3. The upper-wall portion 652*c*-2 is continuous with the board portion 652*c*-1 bent at an approximately right angle at an upper edge of the board portion 652*c*-1 in FIGS. 12A and 12B. The lower-wall portion 652*c*-3 is continuous with the board portion 652*c*-1 bent at an approximately right angle at a lower edge of the board portion 652*c*-1 in FIGS. 12A and 12B. The arm holder 652*c* holds the end portion, through which the rotational axis 652*b* passes, of the retention arm 652*a* such that the retention arm 652*a* is interposed between the upper-wall portion 652*c*-2 and the lower-wall portion 652*c*-3, approximately parallel to the board portion 652*c*-1.

As illustrated in FIG. 11, each of the pair of absorption springs 652*d* is interposed between the corresponding upper-wall portion 652*c*-2 of the arm holder 652*c* and a side edge of the retention arm 652*a* facing the upper-wall portion 652*c*-2.

As illustrated in FIGS. 12A and 12B, a caulking pin 652*c*-4 is secured to the upper-wall portion 652*c*-2 of the arm holder 652*c*, projecting toward the lower-wall portion 652*c*-3, to hold a first end of the absorption spring 652*d*.

Figure 13:
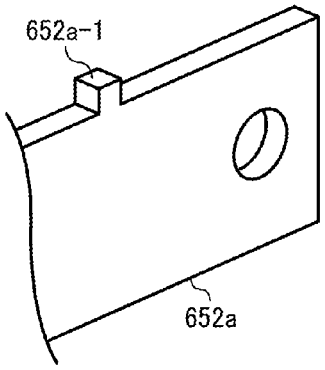
FIG. 13 is a partial view of a retention arm, illustrating an end portion of the retention arm held by one of the pair of arm holders of FIG. 12A or FIG. 12B.
Figure 14:
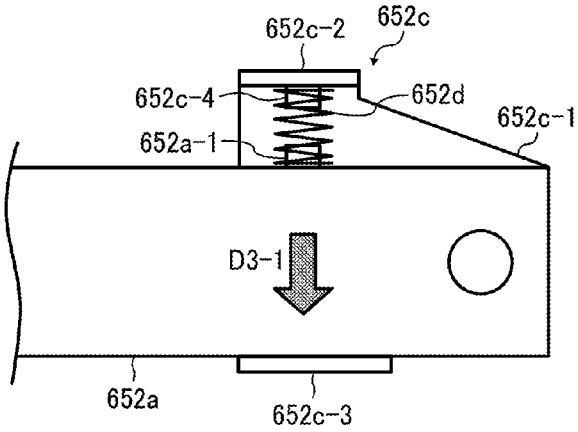
FIG. 14 is a plan view of an absorption spring interposed between the arm holder and the retention arm.

FIG. 13 is a partial view of the retention arm 652*a*, illustrating the end portion of the retention arm 652*a* held by the arm holder 652*c*. FIG. 14 is a plan view of the absorption spring 652*d* interposed between the arm holder 652*c* and the retention arm 652*a*.

As illustrated in FIG. 13, the side edge of the retention arm 652*a* facing the upper-wall portion 652*c*-2 includes projection 652*a*-1 that faces the caulking pin 652*c*-4 illustrated in FIGS. 12A and 12B to hold a second end of the absorption spring 652*d*. As illustrated in FIG. 14, the caulking pin 652*c*-4 of the arm holder 652*c* is fit into the first end of the absorption spring 652*d*, which is a coil spring. The projection 652*a*-1 of the retention arm 652*a* is fit into the second end of the absorption spring 652*d*. At this time, the absorption spring 652*d* is compressed. The retention arm 652*a* is pressed against the lower-wall portion 652*c*-3 in the direction D3-1.

Referring back to FIG. 11, when the pair of arm holders 652*c* is rotated in a direction D3-2, the lower-wall portions 652*c*-3 of the pair of arm holders 652*c* press the pair of retention arms 652*a* upwards, thereby rotating the pair of retention arms 652*a*, and therefore, the separation pad 451 in the direction D3-2. The pair of retention arms 652*a* is rotated in the direction D3-2 until the separation pad 451 reaches the second position illustrated in FIG. 3, according to an output from the rotary encoder 453.

On the other hand, when the pair of arm holders 652*c* is rotated in the direction D3-1, the pair of absorption springs 652*d*, which is interposed between the pair of arm holders 652*c* and the pair of retention arms 652*a*, press the pair of retention arms 652*a* downwards, thereby rotating the pair of retention arms 652*a*, and therefore, the separation pad 451 in the direction D3-1. The pair of retention arms 652*a* is rotated in the direction D3-1 while being held by the pair of arm holders 652*c* until the separation pad 451 reaches the first position illustrated in FIG. 2, according to an output from the rotary encoder 453.

In the present embodiment, the pair of arm holders 652*c* is rotated at a rotational angle such that the separation pad 451 is rotated in the direction D3-1 to slightly pass the first position. However, the rotation of the separation pad 451 stops when the separation pad 451 contacts the transfer regulator 653, that is, when the separation pad 451 is accurately situated at the first position illustrated in FIG. 2. The pair of absorption springs 652*d* absorbs power applied to the separation pad 451 via the pair of retention arms 652*a* by the movement of the pair of arm holders 652*c* toward the first position after the separation pad 451 contacts the transfer regulator 653.

Thus, according to the third embodiment, the separation pad 451 is accurately situated at the first position illustrated in FIG. 2 by contacting the transfer regulator 653. Additionally, the transfer regulators 653 are disposed as a pair so that each of the opposed end portions of the separation pad 451 contacts the corresponding transfer regulator 653. Accordingly, the separation pad 451 is situated at the first position stably, without leaning.

Further, the pair of absorption springs 652*d* absorbs the power applied to the separation pad 451 by further rotation of the pair of arm holders 652*c* to allow the separation pad 451 to securely contact the transfer regulators 653. Such a configuration reduces the load on the driver 452*c*.

According to the embodiments described above, a transfer mechanism (e.g., transfer mechanism 452) switches a separation supporter (e.g., separation pad 451) between a first position and a second position farther from a fixing nip (e.g., fixing nip N) than the first position. For example, the transfer mechanism moves the separation supporter to the first position to curve an endless belt (e.g., fixing belt 401) so as to enhance separation of a recording medium (e.g., sheet P) from the endless belt if the recording medium is pliant. The thin recording medium sinks down after separating from the endless belt and moving away from an outer circumference of the endless belt which is heated, thereby reducing the influences from the heat.

By contrast, if the recording medium is stiff, the transfer mechanism moves the separation supporter to the second position so that the recording medium naturally separates from the endless belt due to the stiffness of the recording medium. Although the stiff recording medium merely sink down after separating from the endless belt, the recording medium proactively separates from the heated endless belt with the separation supporter situated at the second position, thereby reducing the influences from the heat.

Such a configuration reduces influences that the incorporation of the separation supporter has on the recording medium.

The present disclosure has been described above with reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

For example, each of the separation support mechanisms 450, 550 and 650 is described above as an example of the separation support mechanism incorporated in the fixing device 40 of the image forming apparatus 1 according to an embodiment of the present disclosure. However, the separation support mechanism is not limited to the separation support mechanisms 450, 550 or 650. For example, like the fixing device 40 described above, an image removing device that removes an image formed using an ink or toner erasable by heat from a recording medium is known as a device that includes an endless belt to contact a sheet recording medium. The separation support mechanism according to an embodiment of the present disclosure may be incorporated in such an image removing device.

In the embodiments described above, the sheet P is described as an example of a recording medium. However, the recording medium according to an embodiment of the present disclosure is not limited to the sheet P. The recording medium may include any material and may be used for any purpose provided that the recording medium is a sheet recording medium and capable of recording texts and images, such as an overhead projector (OHP) transparency.

In the third embodiment described above, as an example of the separation support mechanism including a transfer regulator, the separation support mechanism 650 is described that controls the movement of the separation pad 451 according to the output from the rotary encoder 453 while regulating the movement of the separation pad 451 with the transfer regulator 653. However, the separation support mechanism according to an embodiment of the present disclosure is not limited to the separation support mechanisms 650. The separation support mechanism according to an embodiment of the present disclosure may control the movement of the separation pad 451 with the photosensor 501 or the perspective sensor 502 according to the second embodiment while regulating the movement of the separation pad 451 with the transfer regulator 653.

What is claimed is:

1. A separation device comprising:

an endless belt heated while rotating;

a rotary body to rotate while pressing against an outer circumferential surface of the endless belt to form an area of contact between the endless belt and the rotary body, through which a recording medium is conveyed while being heated;

a separation supporter to press against an inner circumferential surface of the endless belt downstream from the area of contact between the endless belt and the rotary body in a recording medium conveyance direction to curve the endless belt toward an outer circumferential surface side of the endless belt at a greater curvature than a curvature of the endless belt at the area of contact between the endless belt and the rotary body, so as to support separation of the recording medium from the endless belt while the separation supporter does not contact the rotary body via the endless belt at a first position; and a transfer mechanism to switch the separation supporter between the first position and a second position farther from the area of contact between the endless belt and the rotary body than the first position.

2. The separation device according to claim 1, further comprising a transfer regulator to regulate movement of the separation supporter from the first position to the area of contact between the endless belt and the rotary body upon contact with the separation supporter moving to the first position from the second position.

3. The separation device according to claim 2, wherein the transfer mechanism includes:

a holder to hold and move the separation supporter; and an absorber to absorb power applied to the separation supporter by movement of the holder toward the first position after the separation supporter contacts the transfer regulator.

4. The separation device according to claim 1, further comprising a separation support rotary body, around which the endless belt is entrained, pressed by the rotary body via the endless belt to form the area of contact between the endless belt and the rotary body, wherein the separation support rotary body includes a rotational shaft, wherein the separation supporter is interposed between the endless belt and the separation support rotary body, and wherein the transfer mechanism rotates the separation supporter about a rotational axis coaxial with the rotational shaft of the separation support rotary body.

5. The separation device according to claim 1, further comprising a sensor to detect a position of the separation supporter, wherein the transfer mechanism moves the separation supporter in response to detection by the sensor.

6. The separation device according to claim 1, further comprising a sheet type identification unit to identify a type of the recording medium passing between the endless belt and the rotary body, wherein the recording medium is selected from a plurality of types of recording media differing in stiffness, and wherein the transfer mechanism switches a position of the separation supporter between the first position and the second position in response to identification by the sheet type identification unit.

7. The separation device according to claim 1, wherein a rotational axis of the separation supporter is coaxial with a rotational shaft of a fixing roller.

8. A fixing device comprising:

a rotatable endless belt;

a heater disposed opposite the endless belt to heat the endless belt;

a rotary body to rotate while pressing against an outer circumferential surface of the endless belt to form an area of contact between the endless belt and the rotary body, through which a recording medium bearing a toner image is conveyed while being heated;

a separation supporter to press against an inner circumferential surface of the endless belt downstream from the area of contact between the endless belt and the rotary body in a recording medium conveyance direction to curve the endless belt toward an outer circumferential surface side of the endless belt at a greater curvature than a curvature of the endless belt at the area of contact between the endless belt and the rotary body, so as to support separation of the recording medium from the endless belt while the separation supporter does not contact the rotary body via the endless belt at a first position; and a transfer mechanism to switch the separation supporter between the first position and a second position farther from the area of contact between the endless belt and the rotary body than the first position.

9. The fixing device according to claim 8, further comprising:

a fixing roller configured to stretch out the endless belt toward the rotary body, wherein a rotational axis of the separation supporter is coaxial with a rotational shaft of the fixing roller.

10. An image forming apparatus comprising:

an image forming device to form a toner image; and a fixing device disposed downstream from the image forming device in a recording medium conveyance direction, the fixing device including:

a rotatable endless belt;

a heater disposed opposite the endless belt to heat the endless belt;

a rotary body to rotate while pressing against an outer circumferential surface of the endless belt to form an area of contact between the endless belt and the rotary body, through which a recording medium bearing the toner image is conveyed while being heated;

a separation supporter to press against an inner circumferential surface of the endless belt downstream from the area of contact between the endless belt and the rotary body in the recording medium conveyance direction to curve the endless belt toward an outer circumferential surface side of the endless belt at a greater curvature than a curvature of the endless belt at the area of contact between the endless belt and the rotary body, so as to support separation of the recording medium from the endless belt while the separation supporter does not contact the rotary body via the endless belt at a first position; and a transfer mechanism to switch the separation supporter between the first position and a second position farther from the area of contact between the endless belt and the rotary body than the first position.

11. The image forming apparatus according to claim 10, wherein the fixing device further comprises:

a fixing roller configured to stretch out the endless belt toward the rotary body, wherein a rotational axis of the separation supporter is coaxial with a rotational shaft of the fixing roller.

12. A separation device comprising:

an endless belt heated while rotating;

a rotary body to rotate while pressing against an outer circumferential surface of the endless belt to form an area of contact between the endless belt and the rotary body, through which a recording medium is conveyed while being heated;

a separation supporter to press against an inner circumferential surface of the endless belt downstream from the area of contact between the endless belt and the rotary body in a recording medium conveyance direction to curve the endless belt toward an outer circumferential surface side of the endless belt at a greater curvature than a curvature of the endless belt at the area of contact between the endless belt and the rotary body, so as to support separation of the recording medium from the endless belt;

a transfer mechanism to switch the separation supporter between a first position and a second position farther from the area of contact between the endless belt and the rotary body than the first position; and a transfer regulator to regulate movement of the separation supporter from the first position to the area of contact between the endless belt and the rotary body upon contact with the separation supporter moving to the first position from the second position, wherein the transfer mechanism includes:

a holder to hold and move the separation supporter; and an absorber to absorb power applied to the separation supporter by movement of the holder toward the first position after the separation supporter contacts the transfer regulator.

13. A separation device comprising:

an endless belt heated while rotating;

a rotary body to rotate while pressing against an outer circumferential surface of the endless belt to form an area of contact between the endless belt and the rotary body, through which a recording medium is conveyed while being heated;

a separation supporter to press against an inner circumferential surface of the endless belt downstream from the area of contact between the endless belt and the rotary body in a recording medium conveyance direction to curve the endless belt toward an outer circumferential surface side of the endless belt at a greater curvature than a curvature of the endless belt at the area of contact between the endless belt and the rotary body, so as to support separation of the recording medium from the endless belt;

a transfer mechanism to switch the separation supporter between a first position and a second position farther from the area of contact between the endless belt and the rotary body than the first position; and a separation support rotary body, around which the endless belt is entrained, pressed by the rotary body via the endless belt to form the area of contact between the endless belt and the rotary body, wherein the separation support rotary body includes a rotational shaft, the separation supporter is interposed between the endless belt and the separation support rotary body, and the transfer mechanism rotates the separation supporter about a rotational axis coaxial with the rotational shaft of the separation support rotary body.

14. A separation device comprising:

an endless belt heated while rotating;

a rotary body to rotate while pressing against an outer circumferential surface of the endless belt to form an area of contact between the endless belt and the rotary body, through which a recording medium is conveyed while being heated;

a separation supporter to press against an inner circumferential surface of the endless belt downstream from the area of contact between the endless belt and the rotary body in a recording medium conveyance direction to curve the endless belt toward an outer circumferential surface side of the endless belt at a greater curvature than a curvature of the endless belt at the area of contact between the endless belt and the rotary body, so as to support separation of the recording medium from the endless belt;

a transfer mechanism to switch the separation supporter between a first position and a second position farther from the area of contact between the endless belt and the rotary body than the first position; and a sensor to detect a position of the separation supporter, wherein the transfer mechanism moves the separation supporter in response to detection by the sensor.

* * * * *